US010036141B2

(12) United States Patent
Yokoo et al.

(10) Patent No.: US 10,036,141 B2
(45) Date of Patent: Jul. 31, 2018

(54) CONTROL SYSTEM FOR WORK VEHICLE, CONTROL METHOD AND WORK VEHICLE

(71) Applicant: KOMATSU LTD., Tokyo (JP)

(72) Inventors: Takashi Yokoo, Hirakata (JP); Yuki Shimano, Suita (JP); Tomohiro Nakagawa, Hirakata (JP)

(73) Assignee: KOMATSU LTD., Tokyo (JP)

( * ) Notice: Subject to any disclaimer, the term of this patent is extended or adjusted under 35 U.S.C. 154(b) by 0 days.

(21) Appl. No.: 15/118,480

(22) PCT Filed: Apr. 8, 2016

(86) PCT No.: PCT/JP2016/061541
§ 371 (c)(1),
(2) Date: Aug. 11, 2016

(87) PCT Pub. No.: WO2016/148311
PCT Pub. Date: Sep. 22, 2016

(65) Prior Publication Data
US 2017/0292247 A1 Oct. 12, 2017

(51) Int. Cl.
*E02F 9/20* (2006.01)
*E02F 3/43* (2006.01)
(Continued)

(52) U.S. Cl.
CPC ..... *E02F 9/2041* (2013.01); *E02F 3/32* (2013.01); *E02F 3/439* (2013.01); *E02F 9/2004* (2013.01); *E02F 9/22* (2013.01)

(58) Field of Classification Search
None
See application file for complete search history.

(56) References Cited

U.S. PATENT DOCUMENTS 6,169,948 B1 * 1/2001 Fujishima ..... E02F 3/435 172/4.5
6,718,246 B2 * 4/2004 Griffith ..... E02F 3/84 342/357.31
(Continued)

FOREIGN PATENT DOCUMENTS

CN 103562006 A 2/2014
CN 105386481 A 3/2016
(Continued)

OTHER PUBLICATIONS

International Search Report for the corresponding international application No. PCT/JP2016/061541, dated Jun. 21, 2016.
(Continued)

*Primary Examiner* — Mussa A Shaawat
*Assistant Examiner* — Kyung J Kim
(74) *Attorney, Agent, or Firm* — Global IP Counselors, LLP

(57) ABSTRACT

A control system for a work vehicle having a work implement includes a first operating lever for the work implement, a first operating member and a controller. The first operating member is provided on the first operating lever. The controller is configured to perform an automatic control of the work implement. The controller is configured to perform a function of the automatic control, which is allocated to the first operating member, in response to operating the first operating member when a performance condition, including that the first operating lever is located in a neutral position thereof, is satisfied.

12 Claims, 18 Drawing Sheets

(51) Int. Cl.

| | |
|---|---|
| ***E02F 3/32*** | (2006.01) |
| *E02F 9/22* | (2006.01) |

(56) References Cited

U.S. PATENT DOCUMENTS

| | | | |
|---|---|---|---|
| 8,688,334 | B2 | 4/2014 | Taylor |
| 9,464,410 | B2 | 10/2016 | Johnson et al. |
| 2003/0001751 | A1 | 1/2003 | Ogura et al. |
| 2009/0088933 | A1 | 4/2009 | Kim et al. |
| 2014/0142817 | A1 | 5/2014 | Matsuyama |
| 2014/0172246 | A1 | 6/2014 | Farmer et al. |
| 2016/0053460 | A1 | 2/2016 | Singh et al. |

FOREIGN PATENT DOCUMENTS

| | | | |
|---|---|---|---|
| JP | 10-8493 | A | 1/1998 |
| JP | 2000-163145 | A | 6/2000 |
| JP | 2004-278208 | A | 10/2004 |
| JP | 3869792 | B | 1/2007 |
| KR | 10-2009-0034099 | A | 4/2009 |
| KR | 10-2013-0112062 | A | 10/2013 |

OTHER PUBLICATIONS

The Office Action for the corresponding Korean application No. 10-2016-7020430, dated Jan. 4, 2017.
The Office Action for the corresponding Chinese application No. 201680000624.0, dated Dec. 20, 2017.

* cited by examiner

CONTROL SYSTEM FOR WORK VEHICLE, CONTROL METHOD AND WORK VEHICLE

CROSS-REFERENCE TO RELATED APPLICATIONS

This application is a U.S. National stage application of International Application No. PCT/JP2016/061541, filed on Apr. 8, 2016.

TECHNICAL FIELD

Background

The present invention relates to a control system for a work vehicle, a control method and a work vehicle.

Field of the Invention

There has been conventionally a type of control system for a work vehicle that is configured to perform an automatic control of a work implement. For example, a hydraulic excavator described in Japan Patent No. 3869792 is configured to control a work implement such that a bucket of the work implement does not excavate the earth across a preliminarily set designed terrain.

Additionally, the control system for a work vehicle is provided with an operating member for operating a function of the automatic control. For example, the aforementioned hydraulic excavator is provided with an operating member for changing the position of the designed terrain, and the operating member is provided on a console box disposed rearward of an operating lever for a work implement.

SUMMARY

When the operating member for the automatic control is provided on the console box as with the aforementioned hydraulic excavator, an operator of a work vehicle is required to lose hold of the operating lever for the work implement in order to operate the operating member. Therefore, many motions are required for operating the operating member, and operating the operating member becomes complicated.

It is an object of the present invention to provide a control system for a work vehicle, a control method and a work vehicle whereby a function of an automatic control can be easily operated.

A control system for a work vehicle according to a first aspect of the present invention includes a first operating lever for a work implement, a first operating member and a controller. The first operating member is provided on the first operating lever. The controller is configured to perform an automatic control of the work implement. The controller is configured to perform a function of the automatic control, which is allocated to the first operating member, in response to operating the first operating member when a performance condition, including that the first operating lever is located in a neutral position thereof, is satisfied.

In the control system for the work vehicle according to the present aspect, the first operating member is provided on the first operating lever. With the construction, an operator can operate the first operating member while holding the first operating lever. Accordingly, the function of the automatic control can be easily operated.

Additionally, when the first operating member is provided on the first operating lever, it is concerned that the first operating lever is moved by an erroneous operation during operating the first operating member. In this case, there is a possibility that a motion of the work implement, which is not intended by an operator, is caused when the function of the automatic control, which is allocated to the first operating member, is performed and simultaneously the work implement is actuated by operating the first operating lever. When such an unintentional motion is performed, it becomes difficult to perform a construction work with good quality by the automatic control.

In light of this, the control system for the work vehicle according to the present aspect is configured to perform the function of the automatic control, which is allocated to the first operating member, in response to operating the first operating member when the performance condition, including that the first operating lever is located in its neutral position, is satisfied. Because of the configuration, even when the first operating lever is moved during operation of the first operating member, it is possible to simultaneously prevent performing the function of the automatic control that is allocated to the first operating member and actuating the work implement by operating the first operating lever. Accordingly, it is possible to prevent occurrence of an unintentional motion of the work implement attributed to an erroneous operation and perform a construction work with good quality by the automatic control.

The controller may be configured to control the work implement based on a designed terrain indicating a target shape of a work object in the automatic control. In this case, it is possible to perform a construction work with good quality in accordance with the designed terrain by the automatic control.

The controller may be configured to change a position of the designed terrain in response to operating the first operating member when the performance condition is satisfied. In this case, the operator can easily change the position of the designed terrain by operating the first operating member while holding the first operating lever. Additionally, positional change of the designed terrain is configured not to be performed even when the operator moves the first operating lever from its neutral position by an erroneous operation in trying to change the position of the designed terrain by operating the first operating member. Likewise, positional change of the designed terrain is configured not to be performed even when the first operating member is erroneously operated during operating the first operating lever. Accordingly, it is possible to inhibit a situation that the work implement excavates the earth across the designed terrain.

The first operating member may be an operating member for causing a first function of the automatic control to be performed. The control system for a work vehicle may further include a second operating member for causing a second function of the automatic control to be performed. The second function may be different from the first function. In this case, the operator can perform the plural functions of the automatic control by operating the first and second operating members.

The controller may be configured to enable or disable the automatic control in response to operating the second operating member when the performance condition is satisfied. In this case, the operator can enable or disable the automatic control by operating the second operating member while holding the first operating lever.

Both of the first operating member and the second operating member may be provided on the first operating lever. The controller may be configured to perform the first function in response to operating the first operating member when the performance condition is satisfied. The controller may be configured to perform the second function in response to operating the second operating member when the performance condition is satisfied.

In this case, the operator can easily operate the first operating member and the second operating member while holding the first operating lever. Additionally, as long as the first operating lever is being operated, the first function is configured not to be performed even when the first operating member is operated whereas the second function is configured not to be performed even when the second operating member is operated. Accordingly, it is possible to prevent occurrence of an unintentional motion of the work implement attributed to an erroneous operation and perform a construction work with good quality by the automatic control.

The control system for a work vehicle may further include a second operating lever. The first operating member may be provided on the first operating lever, whereas the second operating member may be provided on the second operating lever. In this case, the operator can easily operate the first operating member while holding the first operating lever. Additionally, the operator can easily operate the second operating member while holding the first operating lever.

The controller may be configured to perform the first function in response to operating the first operating member when a first performance condition, including that the first operating lever is located in the neutral position thereof, is satisfied. The controller may be configured to perform the second function in response to operating the second operating member when a second performance condition, including that the second operating lever is located in a neutral position thereof, is satisfied.

In this case, even when the first operating member is operated, the first function is configured not to be performed as long as the first operating lever is being operated. On the other hand, even when the second operating member is operated, the second function is configured not to be performed as long as the second operating lever is being operated. Accordingly, it is possible to prevent occurrence of an unintentional motion of the work implement attributed to an erroneous operation and perform a construction work with good quality by the automatic control.

The performance condition may include that the first operating lever is located in the neutral position thereof and that the second operating lever is located in a neutral position thereof. The controller may be configured to perform the first function in response to operating the first operating member when the performance condition is satisfied. The controller may be configured to perform the second function in response to operating the second operating member when the performance condition is satisfied.

In this case, even when the first operating member is operated, the first function is configured not to be performed as long as at least either of the first and second operating levers is being operated. On the other hand, even when the second operating member is operated, the second function is configured not to be performed as long as at least either of the first and second operating levers is being operated. Accordingly, it is possible to prevent occurrence of an unintentional motion of the work implement attributed to an erroneous operation and perform a construction work with good quality by the automatic control.

The control system for a work vehicle may further include a third operating member provided on the first operating lever. The performance condition may include that the third operating member is being operated. In this case, the function of the automatic control, which is allocated to the first operating member, is configured to be performed by operating the first operating member while the first operating lever is located in its neutral position and simultaneously the third operating member is being operated. Accordingly, it is possible to more accurately prevent occurrence of an unintentional motion of the work implement attributed to an erroneous operation.

The controller may be configured to perform the first function of the automatic control in response to operating the first operating member when the first performance condition is satisfied. The first performance condition may include that the first operating lever is located in the neutral position thereof and that the third operating member is not being operated. The controller may be configured to perform a third function of the automatic control, which is different from the first function, in response to operating the first operating member when a third performance condition is satisfied. The third performance condition includes that the first operating lever is located in the neutral position thereof and that the third operating member is being operated.

In this case, depending on whether or not the third operating member is being operated, either of the first and third functions can be performed in response to operating the first operating member. Accordingly, more number of functions of the automatic control can be operated by lesser number of operating members.

A method of controlling a work vehicle according to a second aspect of the present invention includes the following steps. In the first step, a positional signal is received that indicates a position of a first operating lever for a work implement. In the second step, an operating signal is received that indicates operating a first operating member provided on the first operating lever. In the third step, it is determined whether or not a performance condition, including that the first operating lever is not being operated by an operator, is satisfied. In the fourth step, a function of an automatic control of the work implement, which is allocated to the first operating member, is performed in response to operating the first operating member when the performance condition is satisfied.

In the method of controlling the work vehicle according to the present aspect, the function of the automatic control of the work implement is allocated to the first operating member provided on the first operating lever. With the construction, an operator can operate the first operating member while holding the first operating lever. Accordingly, the function of the automatic control can be easily operated.

Moreover, even when the first operating lever is moved during operation of the first operating member, the function of the automatic control, which is allocated to the first operating member, is configured not to be performed. Because of the configuration, it is possible to simultaneously prevent performing the function of the automatic control and actuating the work implement by operating the first operating lever. Accordingly, it is possible to prevent occurrence of an unintentional motion of the work implement attributed to an erroneous operation and perform a construction work with good quality by the automatic control.

A work vehicle according to a third aspect of the present invention includes a work implement, a first operating lever for the work implement, a first operating member and a controller. The first operating member is provided on the first operating lever. The controller is configured to perform an automatic control of the work implement. The controller is configured to perform a function of the automatic control, which is allocated to the first operating member, in response to operating the first operating member when a performance condition, including that the first operating lever is located in a neutral position thereof, is satisfied.

In the work vehicle according to the present aspect, the first operating member is provided on the first operating lever. With the construction, an operator can operate the first operating member while holding the first operating lever. Accordingly, the function of the automatic control can be easily operated.

Moreover, even when the first operating lever is moved during operating the first operating member, the function of the automatic control, which is allocated to the first operating member, is configured not to be performed. Because of the configuration, it is possible to simultaneously prevent performing the function of the automatic control and actuating the work implement by operating the first operating lever. Accordingly, it is possible to prevent occurrence of an unintentional motion of the work implement attributed to an erroneous operation and perform a construction work with good quality by the automatic control.

According to the present invention, it is possible to easily operate a function of an automatic control, prevent occurrence of an unintentional motion of a work implement attributed to an erroneous operation, and perform a construction work with good quality by the automatic control.

DESCRIPTION OF EXEMPLARY EMBODIMENTS

Figure 1:
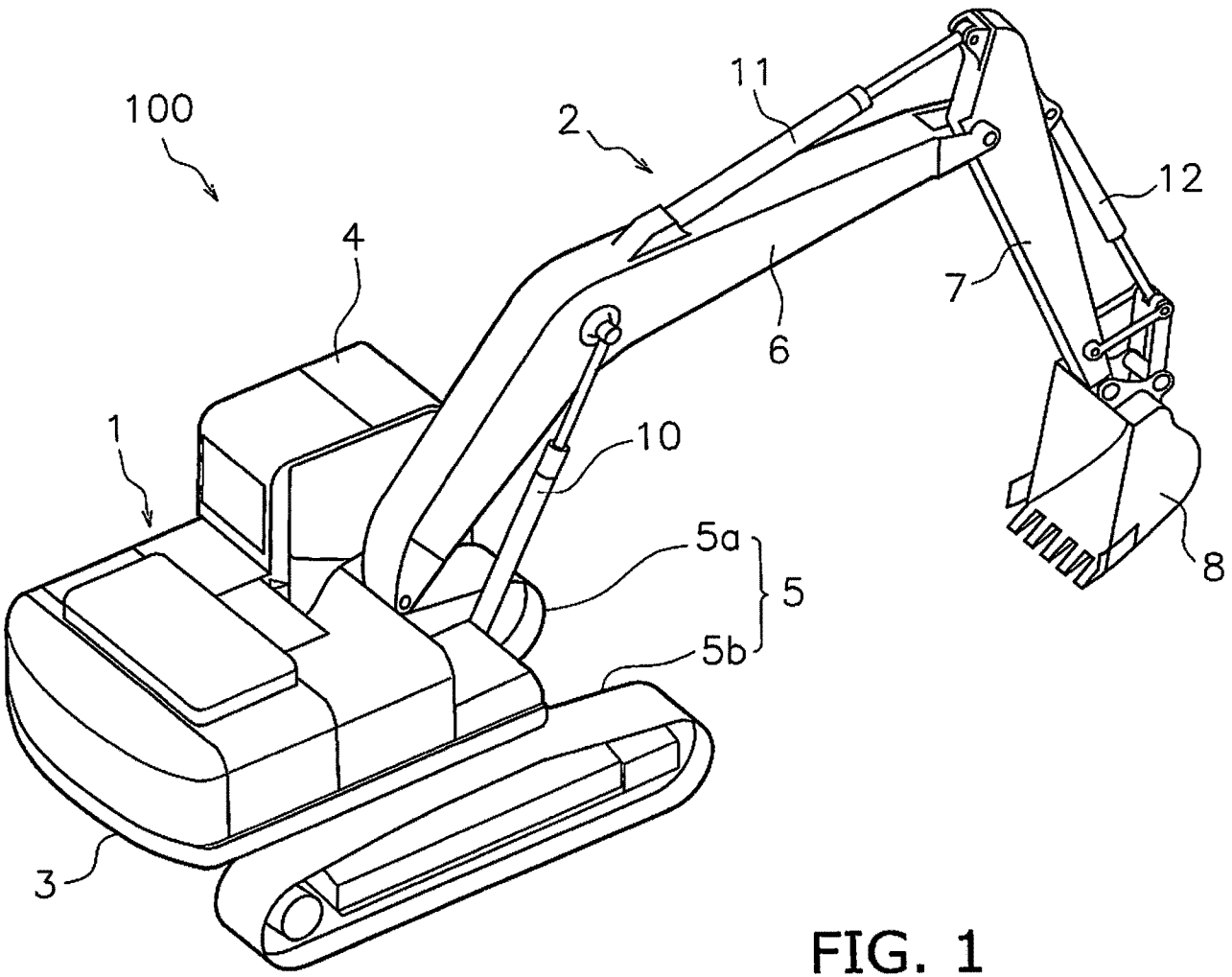
FIG. 1 is a perspective view of a work vehicle according to an exemplary embodiment.

An exemplary embodiment of the present invention will be hereinafter explained with reference to drawings. FIG. 1 is a perspective view of a work vehicle 100 according to the exemplary embodiment. In the exemplary embodiment, the work vehicle 100 is a hydraulic excavator. The work vehicle 100 includes a vehicle body 1 and a work implement 2.

The vehicle body 1 includes a revolving unit 3 and a drive unit 5. The revolving unit 3 accommodates an engine (to be described), hydraulic pumps (to be described) and so forth. A cab 4 is disposed on the revolving unit 3. The drive unit 5 includes crawler belts 5*a* and 5*b*, and the work vehicle 100 is configured to travel when the crawler belts 5*a* and 5*b* are circulated.

The work implement 2 is attached to the vehicle body 1. The work implement 2 includes a boom 6, an arm 7 and a bucket 8. The boom 6 is attached at its base end to the front portion of the vehicle body 1 so as to be capable of being actuated. The arm 7 is attached at its base end to the tip end of the boom 6 so as to be capable of being actuated. The bucket 8 is attached to the tip end of the arm 7 so as to be capable of being actuated.

It should be noted that the bucket 8 is an exemplary work tool. Any work tool other than the bucket 8 may be attached to the tip end of the arm 7.

The work implement 2 includes a boom cylinder 10, an arm cylinder 11 and a bucket cylinder 12. The boom cylinder 10, the arm cylinder 11 and the bucket cylinder 12 are hydraulic cylinders respectively configured to be driven by hydraulic fluid. The boom cylinder 10 is configured to drive the boom 6. The arm cylinder 11 is configured to drive the arm 7. The bucket cylinder 12 is configured to drive the bucket 8.

Figure 2:
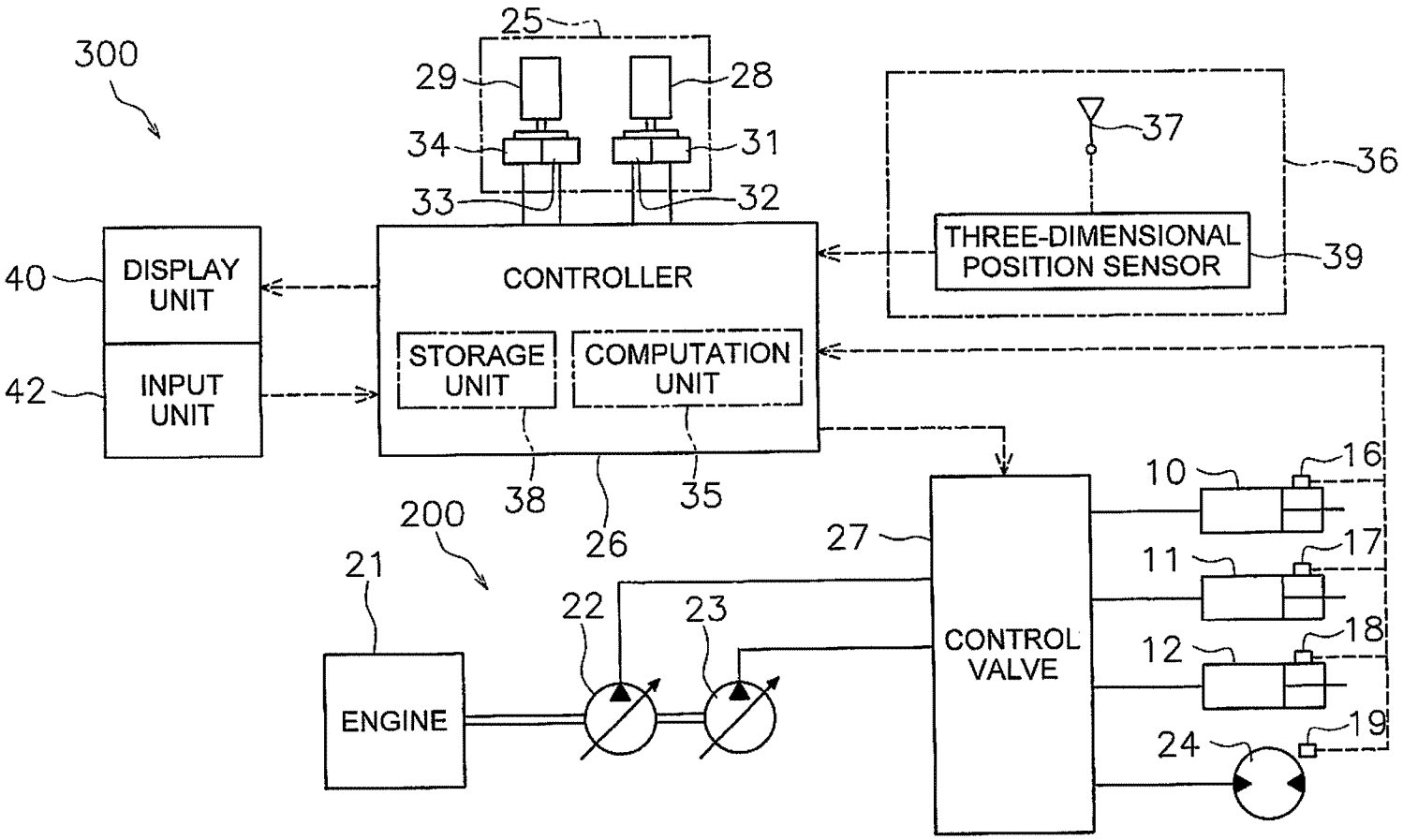
FIG. 2 is a block diagram showing a configuration of a control system of the work vehicle.

FIG. 2 is a block diagram of a configuration of a drivetrain 200 and a control system 300 in the work vehicle 100. As shown in FIG. 2, the drivetrain 200 includes an engine 21 and hydraulic pumps 22 and 23.

The hydraulic pumps 22 and 23 are configured to be driven by the engine 21 and discharge the hydraulic fluid. The hydraulic fluid discharged from the hydraulic pumps 22 and 23 is configured to be supplied to the boom cylinder 10, the arm cylinder 11 and the bucket cylinder 12. Additionally, the work vehicle 100 includes a revolving motor 24. The revolving motor 24 is a hydraulic motor and is configured to be driven by the hydraulic fluid discharged from the hydraulic pumps 22 and 23. The revolving motor 24 is configured to revolve the revolving unit 3.

It should be noted that the two hydraulic pumps 22 and 23 are shown in FIG. 2, but alternatively, only one hydraulic pump may be provided. The revolving motor 24 is not limited to the hydraulic motor, and may be an electric motor.

The control system 300 includes an operating device 25, a controller 26 and a control valve 27. The operating device 25 is a device for operating the work implement 2. The operating device 25 is configured to receive an operation performed by an operator for driving the work implement 2 and output a positional signal in accordance with the amount of this operation. The operating device 25 includes a first operating lever 28 and a second operating lever 29.

The first operating lever 28 is provided to be operable in four directions, i.e., the right, left, back and forth directions. Two of the four operating directions of the first operating lever 28 are allocated to an operation of raising the boom 6 and an operation of lowering the boom 6. The remaining two operating directions of the first operating lever 28 are allocated to an operation of upwardly tilting the bucket 8 and an operation of downwardly tilting the bucket 8.

The second operating lever 29 is provided to be operable in four directions, i.e., the right, left, back and forth directions. Two of the four operating directions of the second operating lever 29 are allocated to an operation of raising the arm 7 (arm damping operation) and an operation of lowering the arm 7 (arm excavating operation). The remaining two operating directions of the second operating lever 29 are allocated to an operation of revolving the revolving unit 3 to the right and an operation of revolving the revolving unit 3 to the left.

It should be noted that the contents of the operations allocated to the first and second operating levers 28 and 29 are not limited to the above and may be changed.

The operating device 25 includes a boom operating portion 31 and a bucket operating portion 32. The boom operating portion 31 is configured to output a positional signal in accordance with the operating amount of the first operating lever 28 for operating the boom 6 (hereinafter referred to as "boom operating amount"). The bucket operating portion 32 is configured to output a positional signal in accordance with the operating amount of the first operating lever 28 for operating the bucket 8 (hereinafter referred to as "bucket operating amount").

The operating device 25 includes an arm operating portion 33 and a revolving motion operating portion 34. The arm operating portion 33 is configured to output a positional signal in accordance with the operating amount of the second operating lever 29 for operating the arm 7 (hereinafter referred to as "arm operating amount"). The revolving motion operating portion 34 is configured to output a positional signal in accordance with the operating amount of the second operating lever 29 for operating the revolving motion of the revolving unit 3. The positional signals from the respective operating portions 31 to 34 are inputted into the controller 26.

The controller 26 is programmed to control the work vehicle 100 based on the obtained information. The controller 26 includes a storage unit 38 and a computation unit 35. The storage unit 38 is composed of memories (e.g., RAM and ROM) and an auxiliary storage device. The computation unit 35 is composed of a processing device (e.g., CPU). The controller 26 is configured to obtain the positional signals from the boom operating portion 31, the arm operating portion 33, the bucket operating portion 32 and the revolving motion operating portion 34. The controller 26 is configured to control the control valve 27 based on these positional signals.

The control valve 27 is an electromagnetic proportional control valve and is configured to be controlled by a command signal from the controller 26. The control valve 27 is disposed between the hydraulic actuators (the boom cylinder 10, the arm cylinder 11, the bucket cylinder 12, the revolving motor 24, etc.) and the hydraulic pumps 22 and 23. The control valve 27 is configured to control the flow rates of the hydraulic fluid to be supplied from the hydraulic pumps 22 and 23 to the boom cylinder 10, the arm cylinder 11, the bucket cylinder 12 and the revolving motor 24.

The controller 26 is configured to control the command signal to be transmitted to the control valve 27 such that the work implement 2 is actuated at a velocity in accordance with the aforementioned operating amounts of the respective operating levers 28 and 29. Accordingly, outputs of the boom cylinder 10, the arm cylinder 11, the bucket cylinder 12, the revolving motor 24 and so forth are controlled in accordance with the operating amounts of the respective operating levers 28 and 29.

It should be noted that the control valve 27 may be a pressure proportional control valve. In this case, pilot pressures are configured to be outputted from the boom operating portion 31, the bucket operating portion 32, the arm operating portion 33 and the revolving motion operating portion 34 in accordance with the operating amounts of the respective operating members, and are configured to be inputted into the control valve 27. The control valve 27 is configured to control the flow rates of the hydraulic fluid to be supplied to the boom cylinder 10, the arm cylinder 11, the bucket cylinder 12 and the revolving motor 24 in accordance with the pilot pressures inputted thereto. In this case, the positional signals from the respective operating portions 31 to 34 may be signals indicating the pilot pressures to be outputted from the respective operating portions 31 to 34.

The control system 300 includes a first stroke sensor 16, a second stroke sensor 17 and a third stroke sensor 18. The first stroke sensor 16 is configured to detect the stroke length of the boom cylinder 10 (hereinafter referred to as "boom cylinder length"). The second stroke sensor 17 is configured to detect the stroke length of the arm cylinder 11 (hereinafter referred to as "arm cylinder length"). The third stroke sensor 18 is configured to detect the stroke length of the bucket cylinder 12 (hereinafter referred to as "bucket cylinder length"). Angle sensors or so forth may be used for measuring the strokes.

The control system 300 includes a tilt angle sensor 19. The tilt angle sensor 19 is disposed in the revolving unit 3. The tilt angle sensor 19 is configured to detect an angle (pitch) of the revolving unit 3 relative to a horizontal plane arranged along the vehicle back-and-forth direction and an angle (roll) of the revolving unit 3 relative to a horizontal plane arranged along the vehicle transverse direction.

These sensors 16 to 19 are configured to transmit detection signals to the controller 26. It should be noted that the revolving angles may be obtained based on positional information of a GNSS antenna 37 to be described. The controller 26 is configured to determine the posture of the work implement 2 based on the detection signals from the sensors 16 to 19.

The control system 300 includes a positional detector 36. The positional detector 36 is configured to detect the present position of the work vehicle 100. The positional detector 36 includes the GNSS antenna 37 and a three-dimensional position sensor 39. The GNSS antenna 37 is provided on the revolving unit 3. The GNSS antenna 37 is an antenna for RTK-GNSS (Real-Time Kinematic GNSS; GNSS refers to Global Navigation Satellite Systems). A signal is configured to be inputted into the three-dimensional position sensor 39 in accordance with GNSS radio waves received by the GNSS antenna 37.

Figure 3:
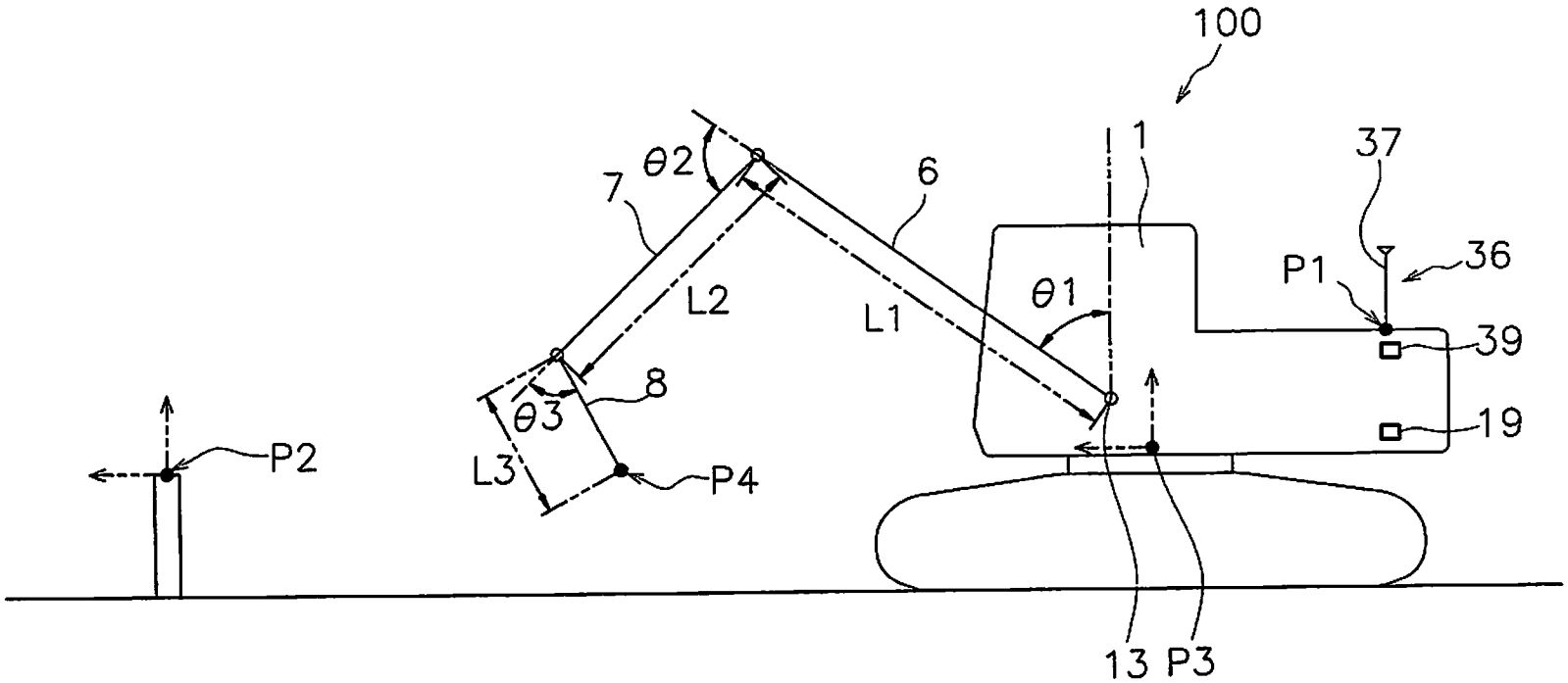
FIG. 3 is a side view of a schematic construction of the work vehicle.

FIG. 3 is a side view of a schematic construction of the work vehicle 100. The three-dimensional position sensor 39 is configured to detect an installation position P1 of the GNSS antenna 37 in a global coordinate system. The global coordinate system is a three dimensional coordinate system based on a reference position P2 set in a work area. As shown in FIG. 3, the reference position P2 is located in, for instance, the tip of a reference marker installed in the work area. The controller 26 is configured to compute the position of a cutting edge P4 of the work implement 2 in the framework of the global coordinate system based on the detection result by the positional detector 36 and the posture of the work implement 2. It should be noted that the cutting edge P4 of the work implement 2 may be expressed as the cutting edge P4 of the bucket 8.

Based on a boom cylinder length detected by the first stroke sensor 16, the controller 26 is configured to calculate a tilt angle θ1 of the boom 6 relative to a vertical direction in a local coordinate system. Based on an arm cylinder length detected by the second stroke sensor 17, the controller 26 is configured to calculate a tilt angle θ2 of the arm 7 relative to the boom 6. Based on a bucket cylinder length detected by the third stroke sensor 18, the controller 26 is configured to calculate a tilt angle θ3 of the bucket 8 relative to the arm 7.

The storage unit 38 of the controller 26 stores work implement data. The work implement data includes a length L1 of the boom 6, a length L2 of the arm 7 and a length L3 of the bucket 8. Additionally, the work implement data includes information of the position of a boom pin 13 relative to a reference position P3 in the local coordinate system. Here, the local coordinate system refers to a three dimensional coordinate system that is set based on the work vehicle 100. The reference position P3 in the local coordinate system is located in, for instance, the revolving center of the revolving unit 3.

The controller 26 is configured to calculate the position of the cutting edge P4 in the local coordinate system based on the tilt angle θ1 of the boom 6, the tilt angle θ2 of the arm 7, the tilt angle θ3 of the bucket 8, the length L1 of the boom 6, the length L2 of the arm 7, the length L3 of the bucket 8 and the positional information of the boom pin 13.

Additionally, the work implement data includes positional information of the installation position P1 of the GNSS antenna 37 relative to the reference position P3 in the local coordinate system. The controller 26 is configured to convert the position of the cutting edge P4 in the local coordinate system into the position of the cutting edge P4 in the global coordinate system based on the detection result by the positional detector 36 and the positional information of the GNSS antenna 37. Accordingly, the controller 26 is configured to obtain the positional information of the cutting edge P4 in the framework of the global coordinate system.

Figure 4:
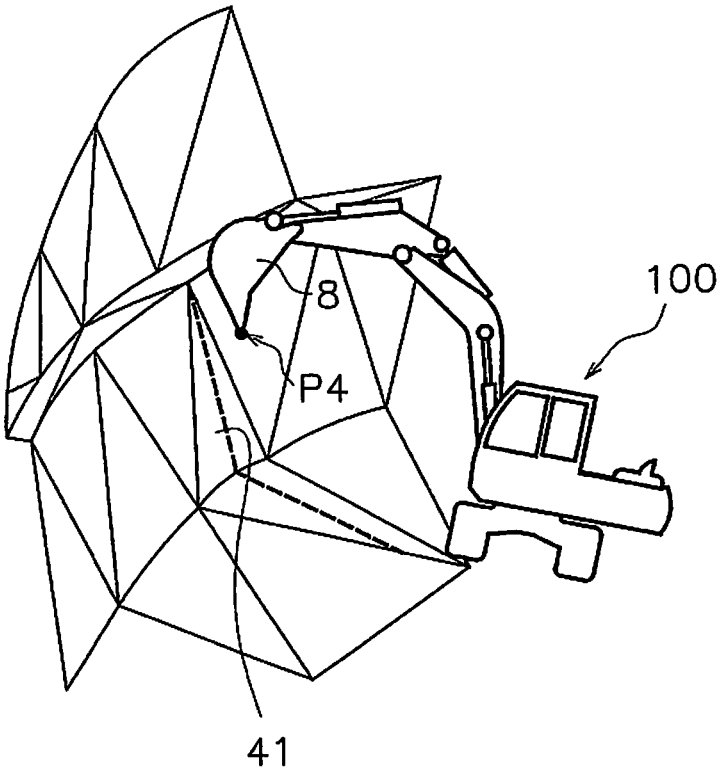
FIG. 4 is a schematic diagram of an exemplary designed terrain.

The storage unit 38 of the controller 26 stores construction work information indicating the shape and the position of a three-dimensional designed terrain within the work area. FIG. 4 is a schematic diagram of an exemplary designed terrain. As shown in FIG. 4, the designed terrain is constructed by a plurality of designed surfaces 41, each of which is expressed by a polygon. The plural designed surfaces 41 respectively indicate a target shape of an excavation object by the work implement 2. It should be noted that in FIG. 4, a reference sign 41 is assigned to only one of the plural designed surfaces 41 without being assigned to the rest of the designed surfaces 41.

The controller 26 is configured to perform an automatic control of the work implement 2 in consideration of the designed surfaces 41. The automatic control includes controlling the work implement 2 such that the bucket 8 is prevented from eroding the designed surfaces 41. In the automatic control, the controller 26 is configured to control the work implement 2 based on the aforementioned construction work information and the positional information of the work implement 2. The automatic control of the work implement 2 means controlling the motion of the work implement 2 by the controller 26 independently from controlling the motion of the work implement 2 based on an operational instruction by the operator through the operating device 25. The automatic control of the work implement 2 includes a fully-automatic control and a semi-automatic control in performing a given work. The automatic control of the work implement 2 to be performed by the controller 26 will be hereinafter explained in detail.

Figure 5:
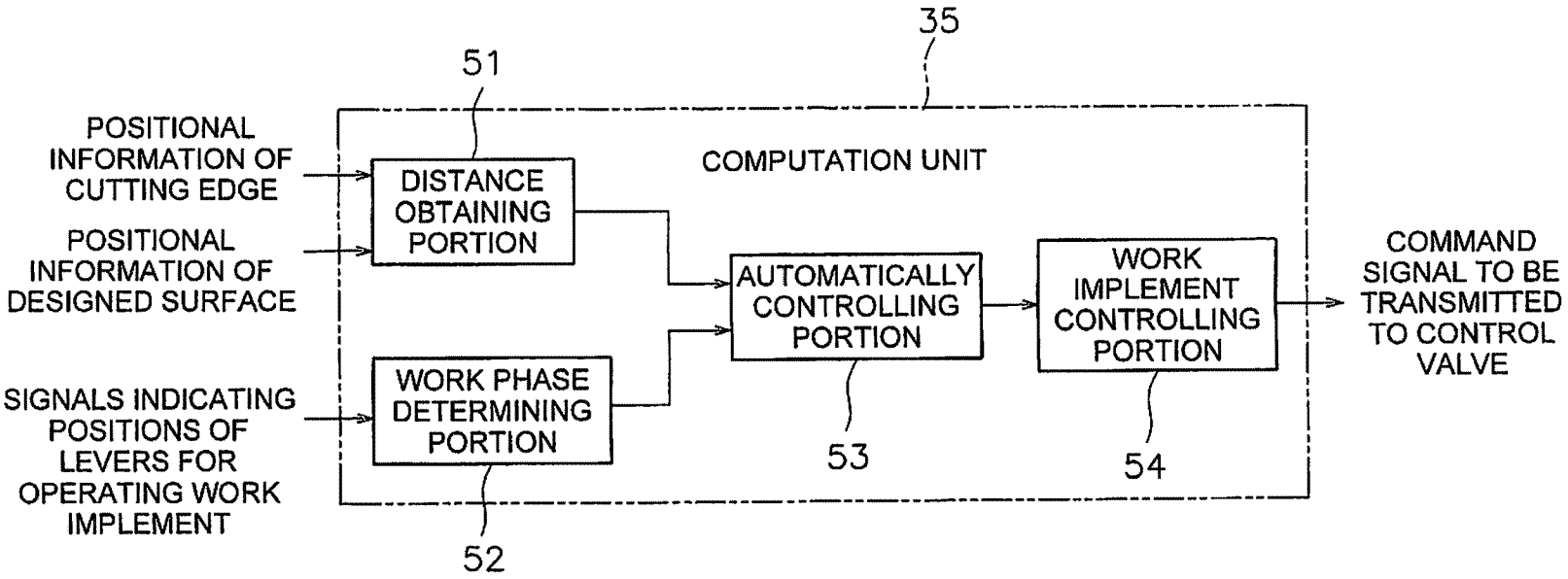
FIG. 5 is a block diagram of a configuration of a controller.
Figure 6:
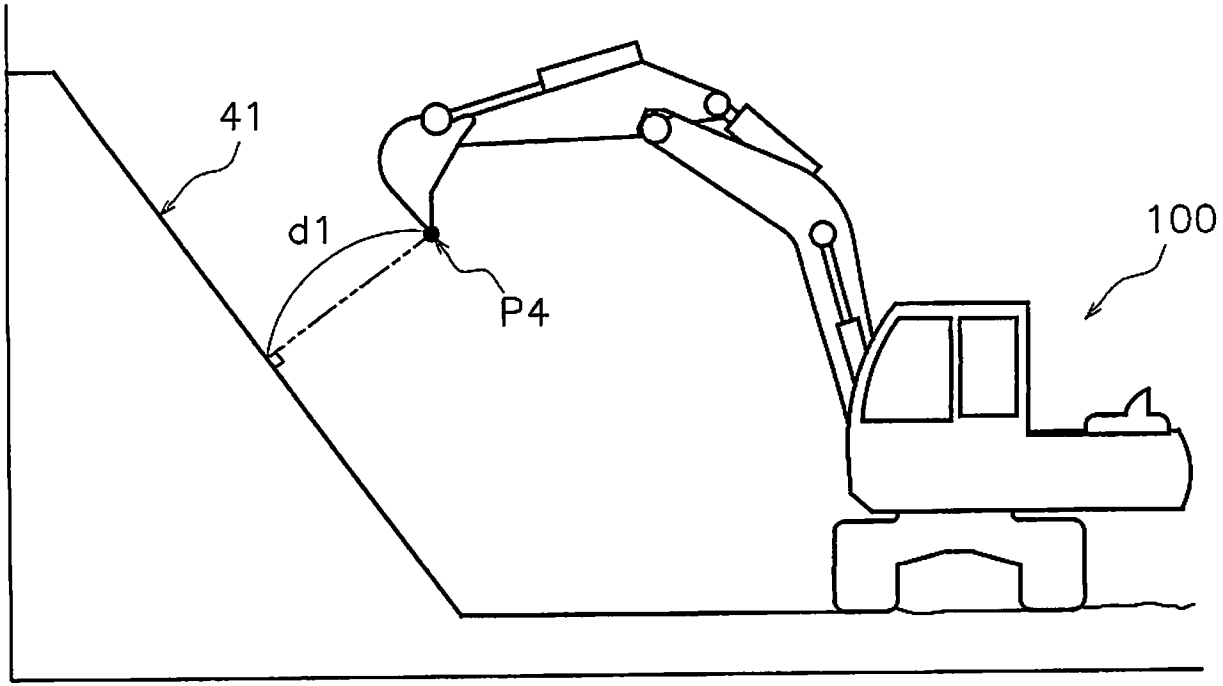
FIG. 6 is a schematic diagram showing a distance between a work implement and a designed surface.

FIG. 5 is a block diagram of a configuration of the controller 26. The computation unit 35 of the controller 26 includes a distance obtaining portion 51, a work phase determining portion 52, an automatically controlling portion 53 and a work implement controlling portion 54. As shown in FIG. 6, the distance obtaining portion 51 is configured to obtain a distance d1 between the work implement 2 and the designed surfaces 41. When described in detail, the distance obtaining portion 51 is configured to calculate the distance d1 between the cutting edge P4 of the work implement 2 and the designed surface 41 based on the aforementioned positional information of the cutting edge P4 of the work implement 2 and the positional information of the designed surface 41.

The work phase determining portion 52 is configured to determine in which phase of work the work implement 2 is engaged. The work phase determining portion 52 is configured to determine in which phase of work (excavation, leveling, etc.) the work implement 2 is engaged based on the aforementioned positional signals from the boom operating portion 31, the arm operating portion 33 and the bucket operating portion 32. For example, when an arm operation is not being performed although either a boom operation or a bucket operation is being performed, the work phase determining portion 52 is configured to determine that the phase of work is excavation. When the arm operation is being performed, the work phase determining portion 52 is configured to determine that the phase of work is leveling.

When the phase of work is excavation, the automatically controlling portion 53 is configured to perform a velocity limiting control. In the velocity limiting control, the automatically controlling portion 53 is configured to gradually limit the velocity of the work implement 2 in accordance with reduction in the distance d1 between the work implement 2 and the designed surfaces 41. In other words, in the velocity limiting control, the automatically controlling portion 53 is configured to gradually lower the upper limit of the velocity of the work implement 2 in accordance with reduction in the distance d1 between the work implement 2 and the designed surface 41. Accordingly, it is possible to inhibit occurrence of a situation that in excavation, the work implement 2 excavates the earth across the designed surface 41.

Figure 7:
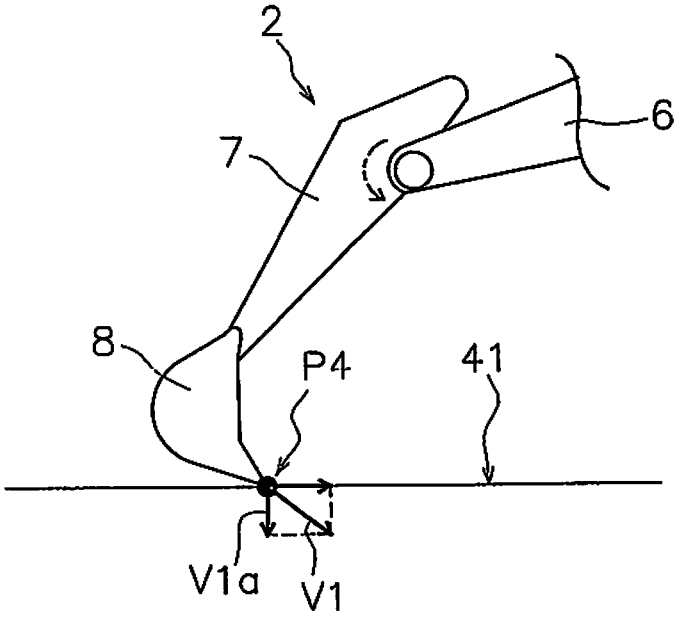
FIG. 7 is a diagram showing a velocity control of the work implement in a leveling control.

When the phase of work is leveling, the automatically controlling portion 53 is configured to perform a leveling control. The leveling control is a control for causing the work implement 2 to move along the designed surfaces 41. As shown in FIG. 7, when the cutting edge P4 of the work implement 2 is moved at a velocity V1 toward the designed surface 41, the automatically controlling portion 53 is configured to calculate a velocity component V1*a* of the velocity V1 that is perpendicular to the designed surface 41. The automatically controlling portion 53 is configured to determine a velocity at which the boom 6 is elevated whereby the perpendicular velocity component V1*a* is canceled out. Accordingly, the work implement 2 is controlled by the leveling control such that the cutting edge P4 can be moved along the designed surface 41.

The work implement controlling portion 54 is configured to output a command signal to the aforementioned control valve 27 so as to control the work implement 2. The work implement controlling portion 54 is configured to determine an output value of the command signal to be outputted to the control valve 27 in accordance with the operating amount of the work implement 2. Additionally, during performing the automatic control, the work implement controlling portion 54 is configured to determine the output value of the command signal to be outputted to the control valve 27 based on the velocity of the work implement 2 determined by the automatically controlling portion 53.

Figure 8:
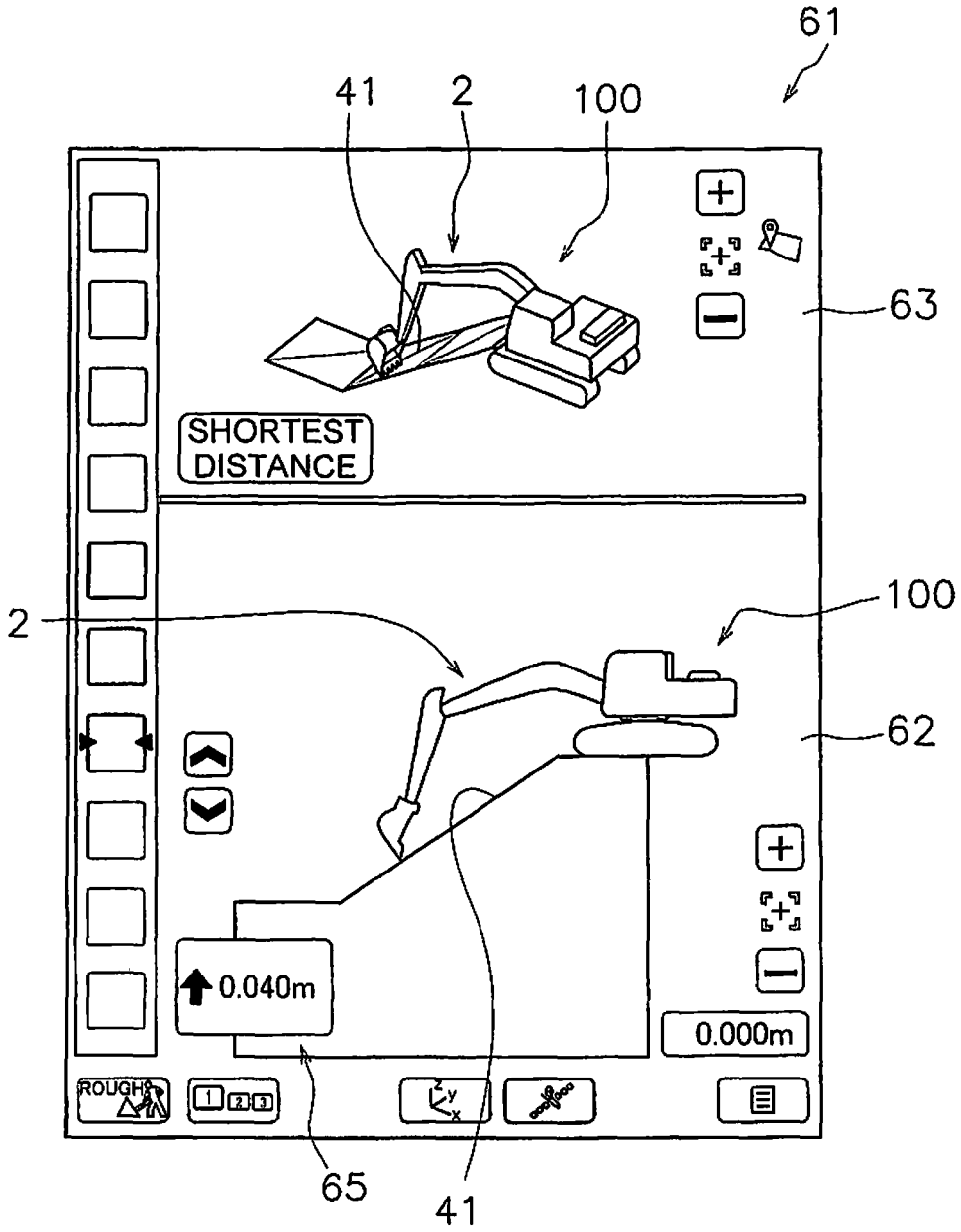
FIG. 8 is a diagram of an exemplary guidance screen.

As shown in FIG. 2, the control system 300 includes a display unit 40. The display unit 40 is a monitor, for instance, and is configured to display information regarding the work vehicle 100. The controller 26 is configured to cause the display unit 40 to display a guidance screen based on a designed terrain and detection results from the aforementioned various sensors. FIG. 8 is a diagram showing an example of a guidance screen 61. As shown in FIG. 8, the guidance screen 61 shows a positional relation between the designed surfaces 41 and the work implement 2.

When described in detail, the guidance screen 61 includes a first guidance screen 62 and a second guidance screen 63. The first guidance screen 62 shows the designed surface 41 and the work implement 2 in the form of a side view. The second guidance screen 63 shows the designed surface 41 and the work implement 2 in the form of a perspective view. The guidance screen 61 includes a distance indicator 65 indicating the distance between the work implement 2 and the designed surface 41. It should be noted that one of the first and second guidance screens 62 and 63 may not be provided.

As shown in FIG. 2, the control system 300 includes an input unit 42. The input unit 42 is a device for inputting settings of the aforementioned automatic control. The operator is capable of changing the settings of the automatic control by operating the input unit 42. In the present exemplary embodiment, the input unit 42 is a touch panel device provided integrally with the display unit 40. It should be noted that the input unit 42 may be provided separately from the display unit 40.

Figure 9A:
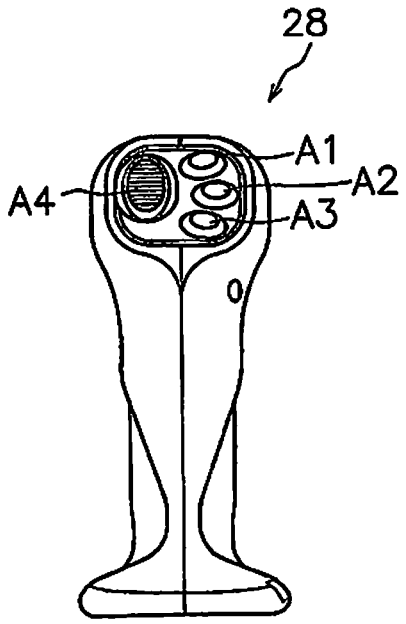
FIGS. 9A and 9B are diagrams of a first operating lever.
Figure 9B:
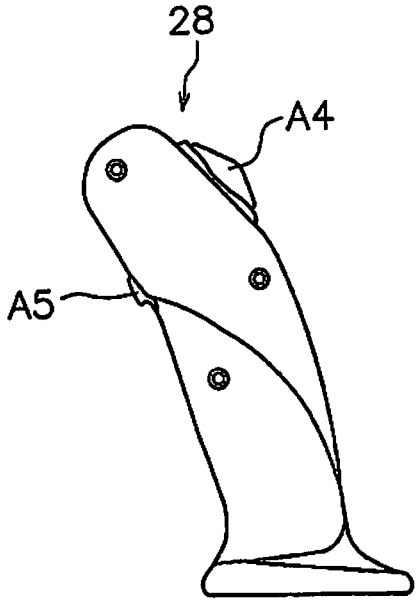

Next, operating the automatic control by the first and second operating levers 28 and 29 will be explained in detail. FIG. 9A is a front view of the first operating lever 28. FIG. 9B is a side view of the first operating lever 28. As shown in FIGS. 9A and 9B, the first operating lever 28 is provided with a plurality of operating members A1, A2, A3, A4 and A5. The operating members A1, A2, A3 and A4 are mounted to the front surface of the first operating lever 28. The operating members A1, A2, A3 and A4 are mounted to the upper portion of the first operating lever 28. The operating member A5 is mounted to the rear surface of the first operating lever 28.

The operating members A1, A2 and A3 are switches of a push button type. An operating signal, which indicates a push-on state or a push-off state of each operating member A1, A2, A3 is inputted to the controller 26 from each operating member A1, A2, A3. The operating member A4 is a switch of a slide type or a rotary type. An operating signal, which corresponds to the operating position of the operating member A4, is inputted to the controller 26 from the operating member A4. The operating member A5 is a switch of a trigger type. An operating signal, which indicates a push-on state or a push-off state of the operating member A5, is inputted to the controller 26 from the operating member A5.

Figure 10A:
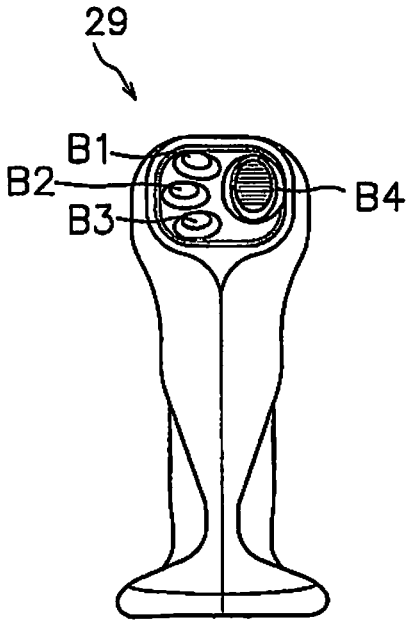
FIGS. 10A and 10B are diagrams of a second operating lever.
Figure 10B:
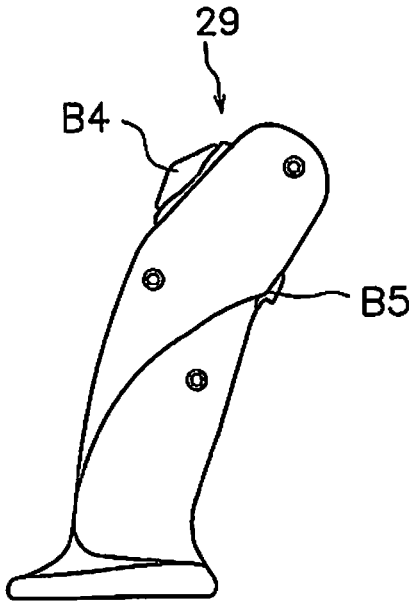

FIG. 10A is a front view of the second operating lever 29. FIG. 10B is a side view of the second operating lever 29. As shown in FIGS. 10A and 10B, the second operating lever 29 is provided with a plurality of operating members B1, B2, B3, B4 and B5. The operating members B1, B2, B3 and B4 are mounted to the front surface of the second operating lever 29. The operating members B1, B2, B3 and B4 are mounted to the upper portion of the second operating lever 29. The operating member B5 is mounted to the rear surface of the second operating lever 29.

The operating members B1, B2 and B3 are switches of a push button type. An operating signal, which indicates a push-on state or a push-off state of each operating member B1, B2, B3 is inputted to the controller 26 from each operating member B1, B2, B3. The operating member B4 is a switch of a slide type or a rotary type. An operating signal, which corresponds to the operating position of the operating member B4 is inputted to the controller 26 from the operating member B4. The operating member B5 is a switch of a trigger type. An operating signal, which indicates a push-on state or a push-off state of the operating member B5, is inputted to the controller 26 from the operating member B5.

Functions of the automatic control are allocated to portion of these operating members A1-A5 and B1-B5. In the present exemplary embodiment, functions of the automatic control are allocated to the operating members A2, B2 and A5.

It should be noted that operations related to the work implement 2 and those related to the vehicle body 1 are allocated to the operating members other than the operating members A2, B2 and A5. The operations related to the work implement 2 include, for instance, an operation of a work tool such as a breaker that is employed instead of the bucket 8 and is attached to the work implement 2. The operations related to the vehicle body 1 include, for instance, an operation to increase engine output, an operation to blow a horn, and so forth.

When described in detail, a function of elevating the position of the designed surfaces 41 is allocated to the operating member A2. The position of the designed surface 41 is configured to be changed upward in response to the operation of the operating member A2. In response to a single operation of the operating member A2, the position of the designed surface 41 is configured to be changed upward by a predetermined distance.

Figure 11:
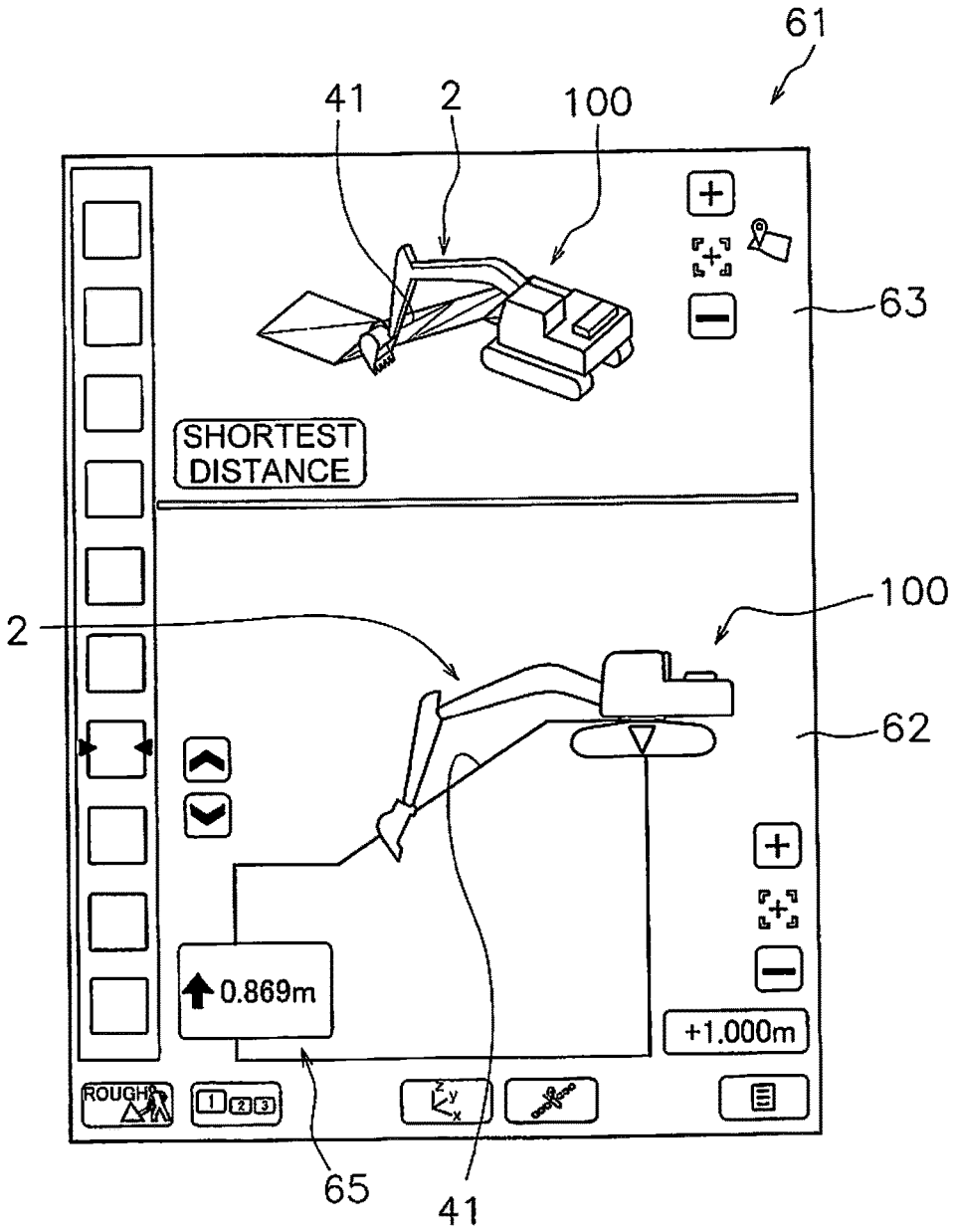
FIG. 11 is a diagram of an exemplary guidance screen in operating an operating member.
Figure 12:
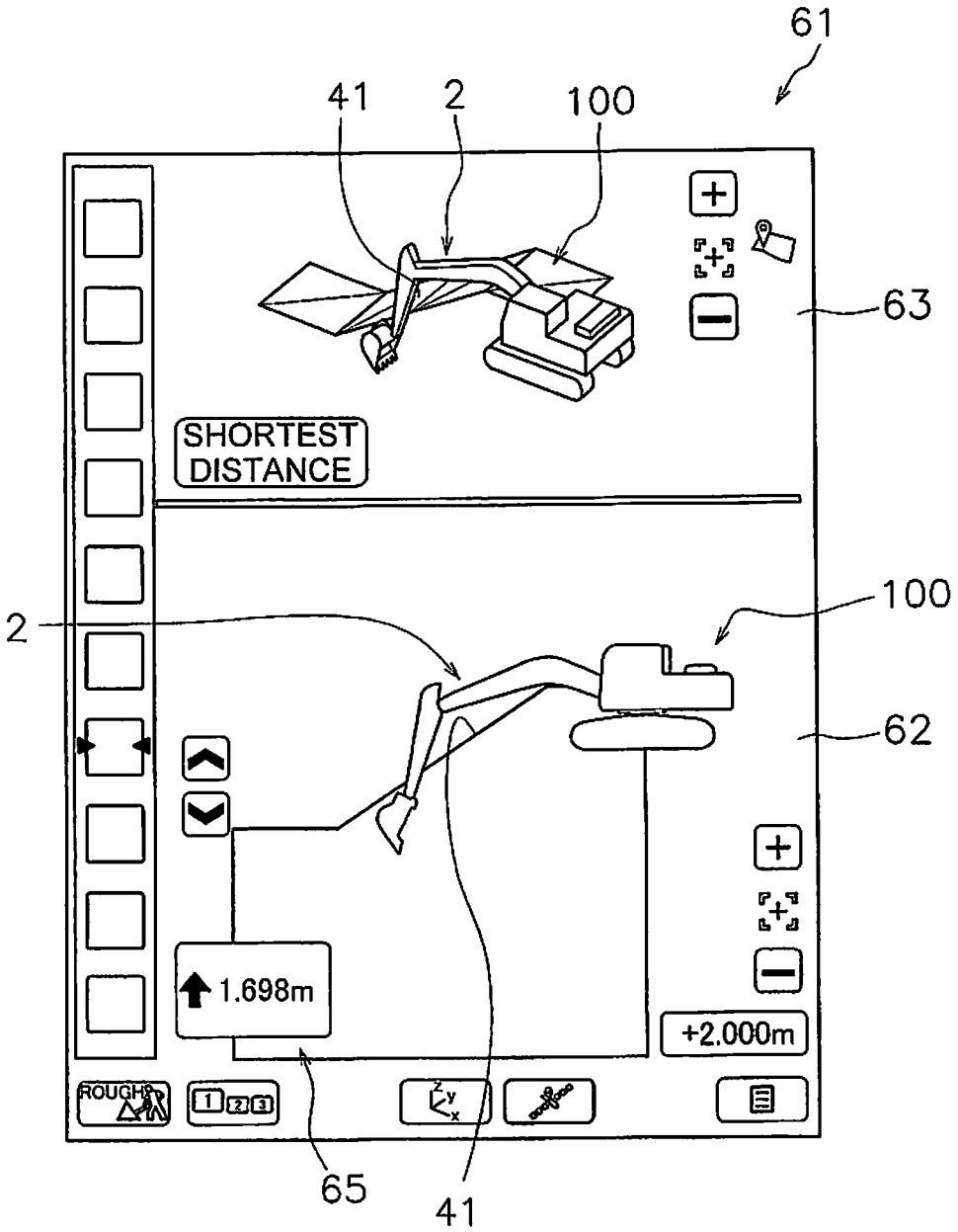
FIG. 12 is a first diagram of an exemplary guidance screen in operating the operating member.

FIG. 11 shows a condition that as a result of pressing the operating member A2 once, the designed surface 41 has been moved upward from its initial position (see FIG. 8) by the predetermined distance in the guidance screen 61. FIG. 12 shows a condition that as a result of pressing the operating member A2 once again, the designed surface 41 has been moved further upward by the predetermined distance in the guidance screen 61.

Figure 13:
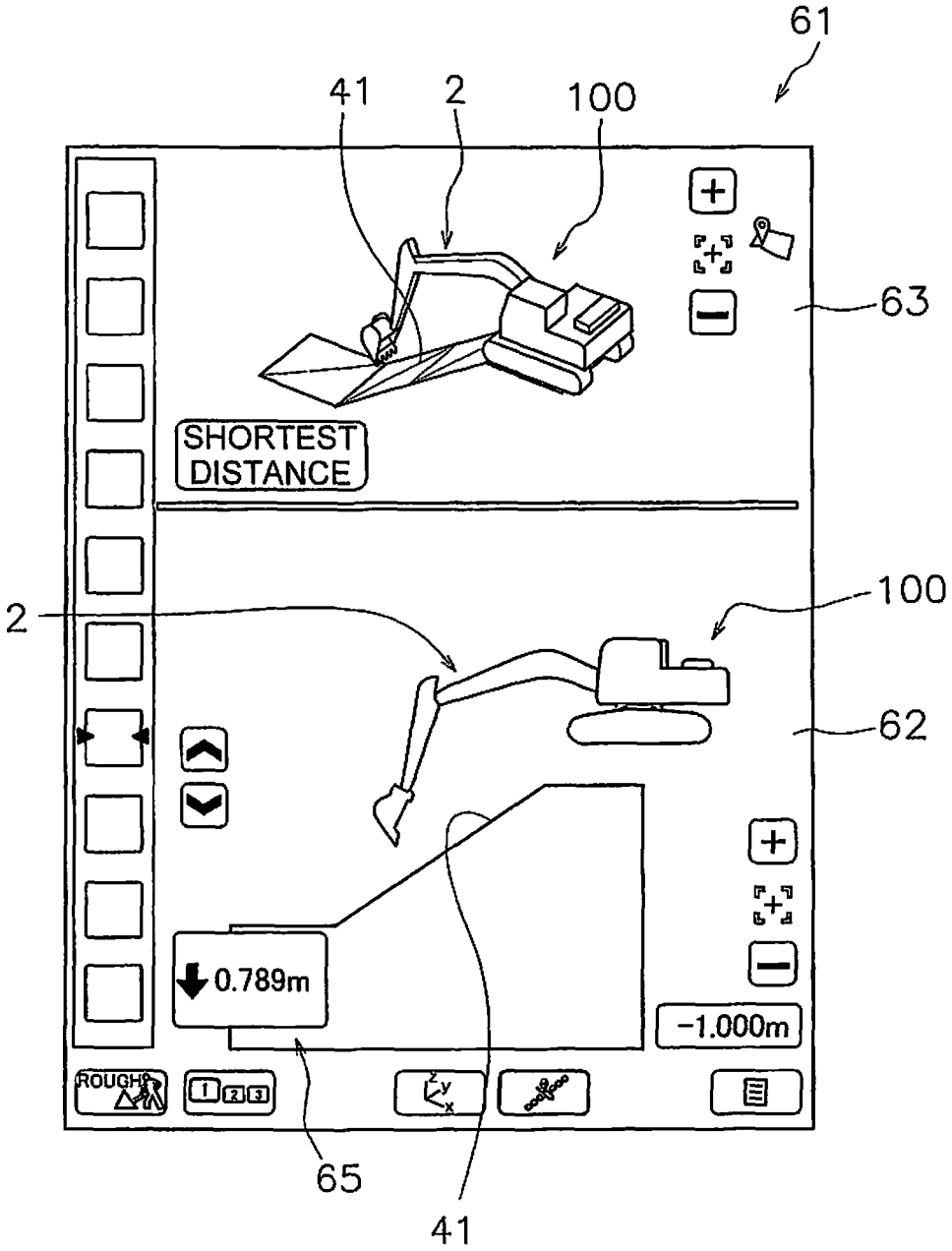
FIG. 13 is a second diagram of an exemplary guidance screen in operating the operating member.
Figure 14:
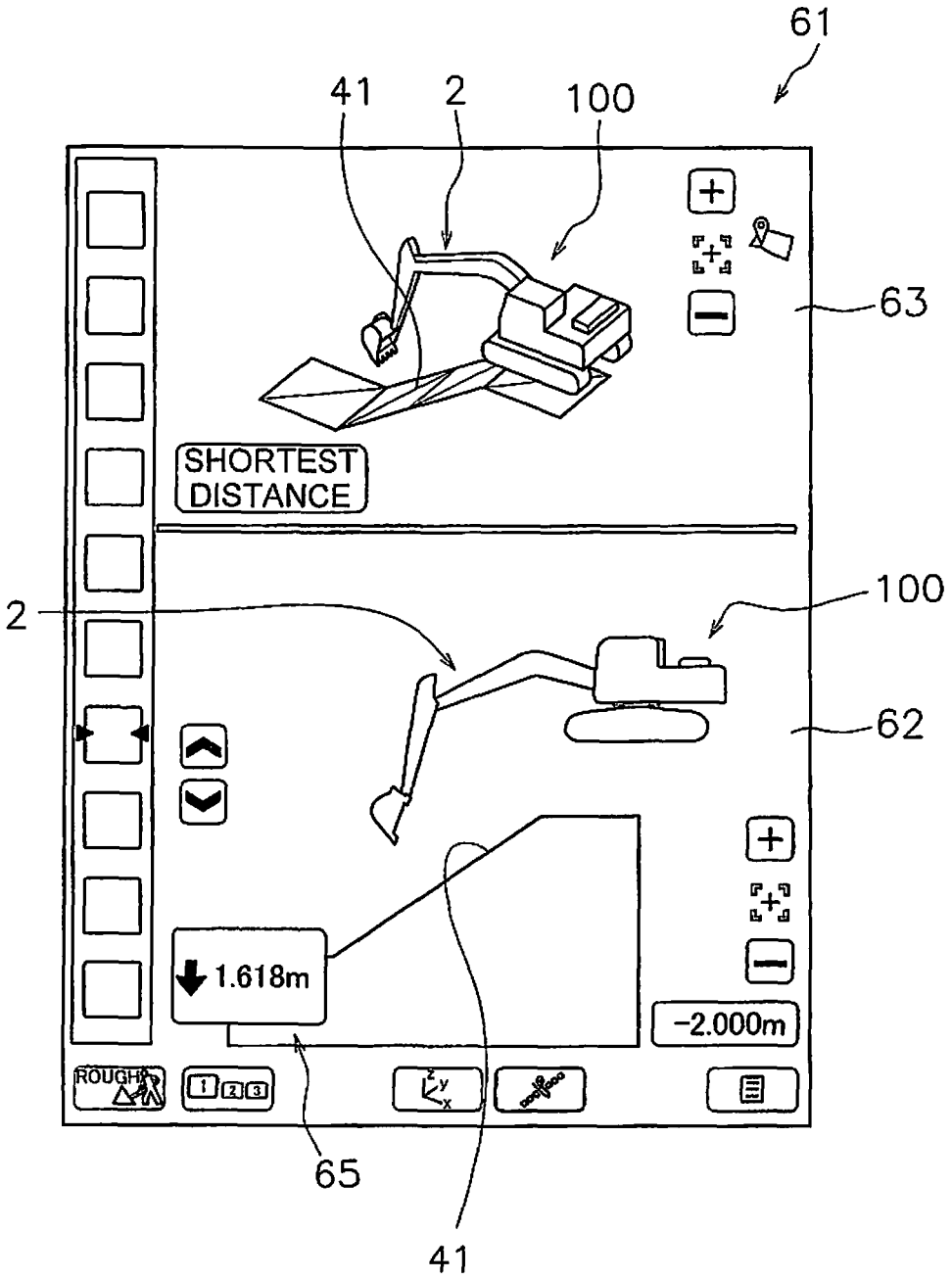
FIG. 14 is a third diagram of an exemplary guidance screen in operating the operating member.

A function of lowering the position of the designed surface 41 is allocated to the operating member B2. The position of the designed surface 41 is configured to be changed downward in response to the operation of the operating member B2. In response to a single operation of the operating member B2, the position of the designed surface 41 is configured to be changed downward by the predetermined distance. FIG. 13 shows a condition that as a result of pressing the operating member B2 once, the designed surface 41 has been moved downward from its initial position (see FIG. 8) by the predetermined distance in the guidance screen 61. FIG. 14 shows a condition that as a result of pressing the operating member B2 once again, the designed surface 41 has been moved further downward by the predetermined distance in the guidance screen 61.

As described above, when the operating member A2 or B2 is operated, the position of the designed surface 41 is configured to be changed upward or downward in the guidance screen 61. Then, the aforementioned automatic control is configured to be performed based on the changed position of the designed surface 41. It should be noted that the aforementioned predetermined distance may be changeable by operating the input unit 42. Alternatively, the aforementioned predetermined distance may be a fixed value.

A function of enabling/disabling the automatic control is allocated to the operating member A5. Every time the operating member A5 is operated, enabling and disabling the automatic control are configured to be alternately switched. Enabling the automatic control means that the automatic control is allowed to be performed. Disabling the automatic control means that the automatic control is not allowed to be performed and the operating mode of the work implement 2 is set to a manual mode in which the work implement 2 is manually operated.

As described above, the operator is capable of causing the functions of the automatic control, which are respectively allocated to the operating members A2, B2 and A5, to be performed by operating the operating members A2, B2 and A5. It should be noted that the controller 26 is configured to perform the functions of the automatic control, which are respectively allocated to the operating members A2, B2 and A5, when a performance condition is satisfied.

The performance condition is a condition that the operating levers are not being operated by the operator to actuate the work implement 2. In the present exemplary embodiment, the performance condition is a condition that the first operating lever 28 is located in its neutral position and simultaneously the second operating lever 29 is located in its neutral position. Therefore, the position of the designed surface 41 is configured to be moved upward by operating the operating member A2 when both of the first and second operating levers 28 and 29 are located in their neutral positions. The position of the designed surface 41 is configured to be moved downward by operating the operating member B2 when both of the first and second operating levers 28 and 29 are located in their neutral positions. Even when either of the operating members A2 and B2 is operated, the position of the designed surface 41 is configured not to be changed as long as at least either of the first and second operating levers 28 and 29 has been operated and is located in a different position from its neutral position.

On the other hand, the automatic control is configured to be switched from enabled to disabled or vice versa by operating the operating member A5 when both of the first and second operating levers 28 and 29 are located in their neutral positions. Even when the operating member A5 is operated, the automatic control is configured not to be switched from enabled to disabled or vice versa as long as at least either of the first and second operating levers 28 and 29 has been operated and is located in a different position from its neutral position.

Figure 15:
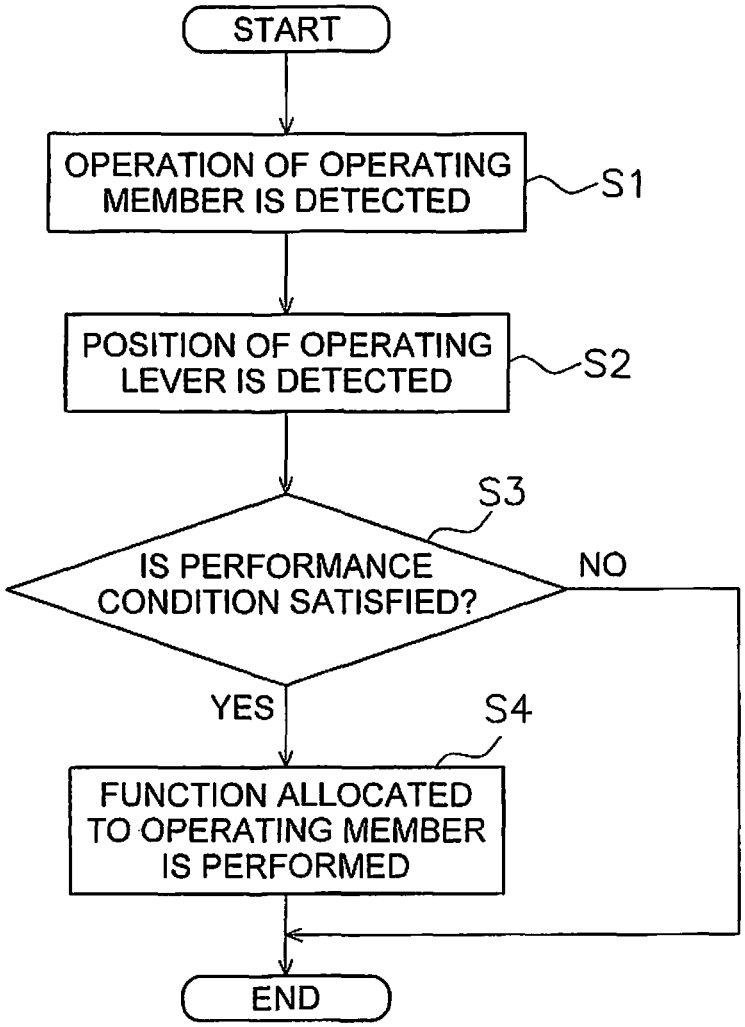
FIG. 15 is a flowchart showing a series of processing steps to be performed in operating the operating member.

FIG. 15 is a flowchart showing a series of processing steps to be performed in operating any of the operating members A2, B2 and A5. A situation that the operating member A2 has been operated will be herein explained as an example.

As shown in FIG. 15, in Step S1, an operation of the operating member A2 is detected. Here, the controller 26 detects the operation of the operating member A2 when receiving the operating signal from the operating member A2.

In Step S2, the positions of the operating levers 28 and 29 are detected. Here, the controller 26 detects the position of the first operating lever 28 when receiving the positional signal indicating the position of the first operating lever 28 from the operating device 25. Likewise, the controller 26 detects the position of the second operating lever 29 when receiving the positional signal indicating the position of the second operating lever 29 from the operating device 25.

In Step S3, it is determined whether or not the performance condition is satisfied. Here, the controller 26 determines whether or not the first operating lever 28 is located in its neutral position and simultaneously the second operating lever 29 is located in its neutral position. When both of the first and second operating levers 28 and 29 are located in their neutral positions, the controller 26 determines that the performance condition is satisfied. When at least either of the first and second operating levers 28 and 29 is located in a different position from its neutral position, the controller 26 determines that the performance condition is not satisfied.

When the performance condition is satisfied, the function allocated to the operating member A2 is performed in Step S4. Here, the controller 26 is configured to change the position of the designed surfaces 41 upward. Even when the operating member A2 is operated, the function of the operating member A2 is configured not to be performed as long as the performance condition has not been satisfied. In other words, even when the operating member A2 is operated, the position of the designed surface 41 is configured not to be changed as long as the performance condition has not been satisfied.

It should be noted that when the operating member B2 is operated, the position of the designed surface 41 is moved downward in Step S4. When the operating member A5 is operated, the automatic control is switched from enabled to disabled or vice versa in Step S4. It should be noted that the functions allocated to the operating members A2, B2 and A5 are also operable through the input unit 42.

In the control system 300 of the work vehicle 100 according to the present exemplary embodiment explained above, the first operating lever 28 is provided with the operating members A2 and A5. With the construction, the operator is capable of operating the operating members A2 and A5 while holding the first operating lever 28. Accordingly, the functions of the automatic control, which is allocated to the operating members A2 and A5, can be easily operated. Likewise, the second operating lever 29 is provided with the operating member B2. With the construction, the operator can operate the operating member B2 while holding the second operating lever 29. Accordingly, the function of the automatic control, which is allocated to the operating member B2, can be easily operated.

Specifically, the operator can change the position of the designed surfaces 41 upward and downward by operating the operating members A2 and B2 while holding the first and second operating levers 28 and 29. Additionally, the operator can switch the automatic control from enabled to disabled or vice versa by operating the operating member A5 while holding the first operating lever 28.

Moreover, even when the operating members A2, B2 and A5 are operated, the functions of the automatic control, which are respectively allocated to the operating members A2, B2 and A5, are configured not to be performed as long as at least either of the first and second operating levers 28 and 29 is located in a different position from its neutral position. Because of the configuration, even when either of the first and second operating levers 28 and 29 is moved during operating the operating members A2, B2 and A5, it is possible to simultaneously prevent performing the functions of the automatic control, which are respectively allocated to the operating members A2, B2 and A5, and prevent actuating the work implement 2 by operating either of the first and second operating levers 28 and 29. Accordingly, it is possible to prevent occurrence of an unintentional motion of the work implement 2 attributed to an erroneous operation and perform a construction work with good quality by the automatic control.

One exemplary embodiment of the present invention has been described above. However, the present invention is not limited to the aforementioned exemplary embodiment, and a variety of changes can be made without departing from the scope of the present invention.

The work vehicle 100 is not limited to the hydraulic excavator, and may be any type of vehicle (e.g., bulldozer, wheel loader, etc.) as long as it is provided with a work implement.

The work vehicle 100 may be configured to be remotely controllable. Specifically, the controller 26 may be divided into a remote controller disposed outside the work vehicle 100 and an in-vehicle embedded controller disposed inside the work vehicle 100, and the remote controller and the in-vehicle embedded controller may be configured to be capable of communicating with each other.

The method of determining the position of the cutting edge P4 of the work implement 2 is not limited to that of the aforementioned exemplary embodiment, and may be changed. For example, the positional detector 36 may be disposed on the cutting edge P4 of the work implement 2.

The method of detecting the distance d1 between the work implement 2 and the designed surfaces 41 is not limited to that of the aforementioned exemplary embodiment, and may be changed. For example, the distance d1 between the work implement 2 and the designed surface 41 may be detected by an optical distance meter, an ultrasonic distance meter or a laser distance meter.

Conditions to be satisfied for performing the functions of the automatic control in accordance with operating the operating members A2, B2 and A5 may be set differently from each other. For example, the condition (first performance condition) to be satisfied in operating the operating members A2 and A5 of the first operating lever 28 may include that the first operating lever 28 is located in the neutral condition but may not include that the second operating lever 29 is located in the neutral position. On the other hand, the condition (second performance condition) to be satisfied in operating the operating member B2 of the second operating lever 29 may include that the second operating lever 29 is located in the neutral position and may not include that the first operating lever 28 is located in the neutral position.

In the aforementioned exemplary embodiment, the operating member A2 (first operating member) for changing the position of the designed surfaces 41 upward and the operating member B2 (second operating member) for changing the position of the designed surface 41 downward are respectively provided for the different operating levers 28 and 29. However, the operating members A2 and B2 may be provided for the same operating lever. Alternatively, the function of changing the position of the designed surface 41 upward and downward may be allocated to an operating member designed to be operable up and down such as the operating member A4 or the operating member B4.

The constructions of the first and second operating levers 28 and 29 may be changed. The number, positional arrangements or shapes of the operating members provided for the first operating lever 28 and that or those of the operating members provided for the second operating lever 29 may be changed. The operating members to which the functions of the automatic control are allocated are not limited to the operating members A2, B2 and A5, and may be the other operating members.

Figure 16:
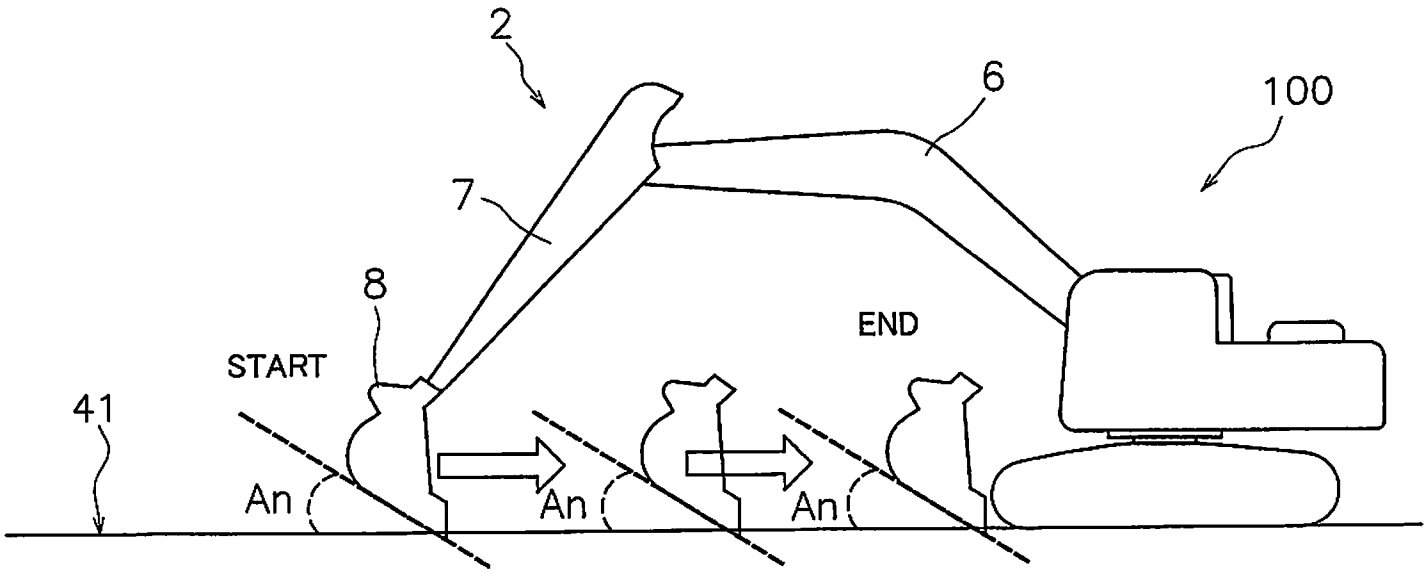
FIG. 16 is a diagram showing a series of motions to be performed by the work implement in an angle maintaining control.

The functions of the automatic control to which the operating members are allocated are not limited to changing the position of the designed surfaces 41 and switching the automatic control from enabled to disabled or vice versa, and may be the other functions. It is preferable to allocate a frequently used function of the automatic control to an operating member. For example, as shown in FIG. 16, the automatic control may include an angle maintaining control for maintaining constant an angle An of the bucket 8 relative to the designed surface 41 in the leveling control. Switching the angle maintaining control from enabled to disabled or vice versa may be allocated to the operating member.

Figure 17:
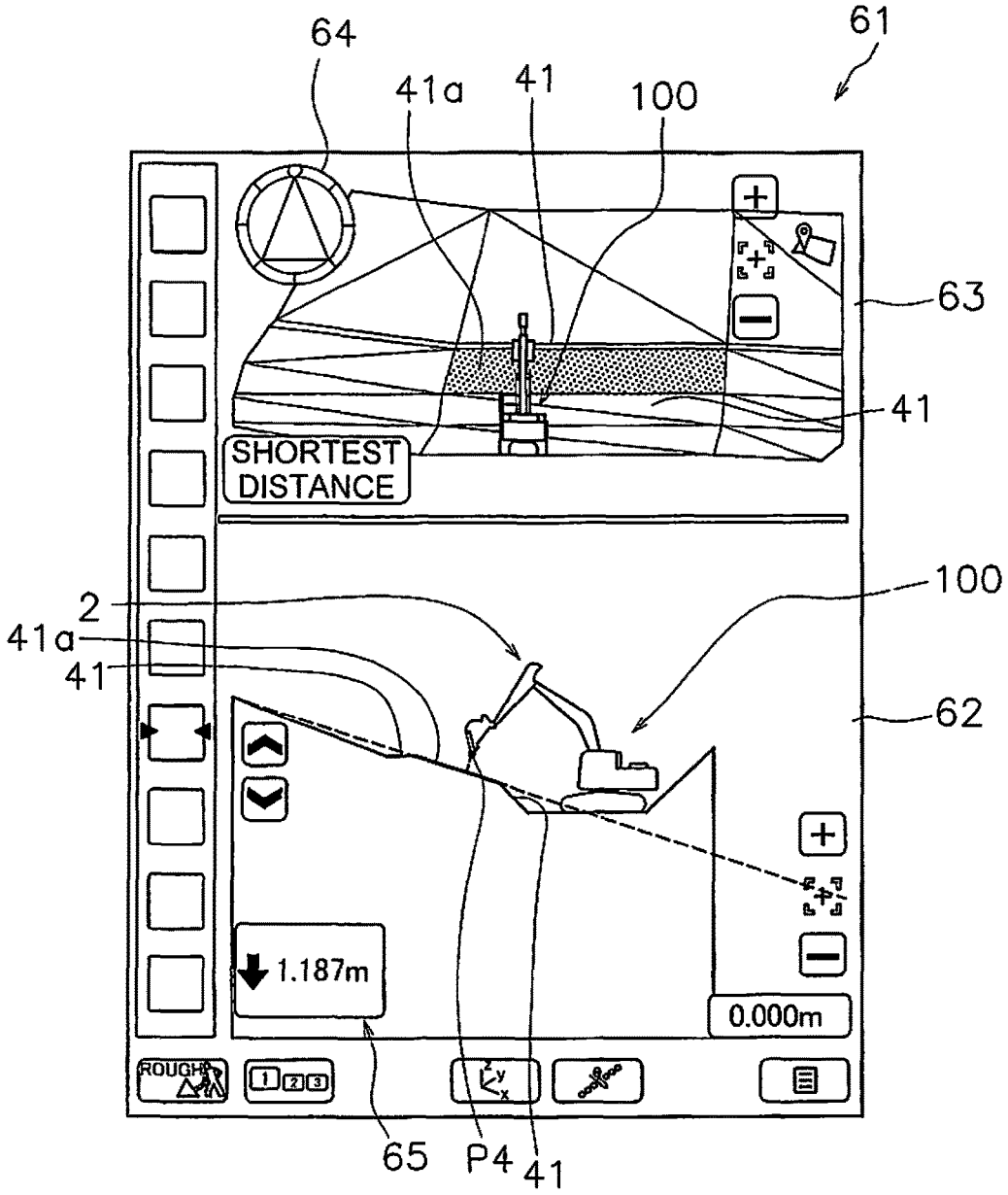
FIG. 17 is a diagram of an exemplary guidance screen in operating the operating member.

A function of selecting a specific one of the plural designed surfaces 41 may be allocated to an operating member. For example, as shown in FIG. 17, a function of selecting a designed surface 41*a* located immediately below the cutting edge P4 may be allocated to the operating member. The aforementioned automatic control may be configured to be performed based on the selected designed surface 41*a*. Alternatively, the selected designed surface 41*a* may be configured to be displayed with a different aspect (e.g., different color) from the other designed surfaces 41. Alternatively, the guidance screen 61 may be configured to display whether or not the work vehicle 100 faces to the selected designed surface 41*a*. FIG. 17 shows that the guidance screen 61 displays whether or not the work vehicle 100 faces to the selected designed surface 41*a* with a compass icon 64.

Figure 18:
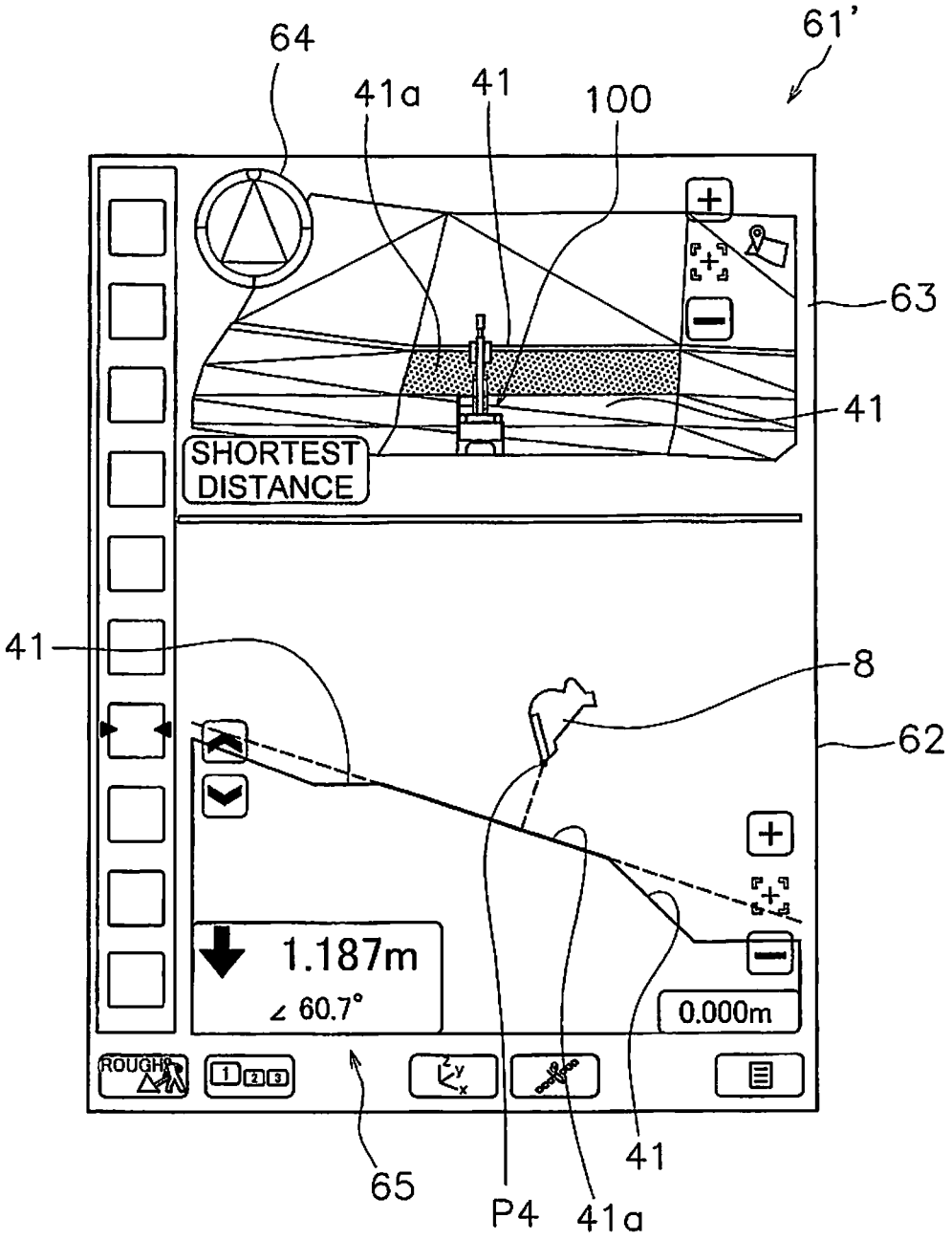
FIG. 18 is a diagram of an exemplary guidance screen in operating the operating member.

A function of changing display scaling in the guidance screen 61 may be allocated to an operating member. For example, a function of switching between the guidance screen 16 taking the form of schematic display as shown in FIG. 17 and a guidance screen 61' taking the form of detail display as shown in FIG. 18 may be allocated to the operating members. The designed surfaces 41 and 41*a* may be configured to be displayed with larger sizes in the detailed display shown in FIG. 18 than in the schematic display shown in FIG. 17. Additionally, in the schematic display shown in FIG. 17, the entirety of the work vehicle 100 may be configured to be displayed on the guidance screen 61. Compared to this, in the detailed display shown in FIG. 18, only the bucket 8 may be displayed with a larger scale on the guidance screen 61' than in the schematic display.

The conditions to be satisfied for performing the functions of the automatic control in accordance with operating the predetermined operating members may further include operating the other operating member different from the predetermined operating members. For example, one of the functions of the automatic control may be configured to be performed by operating the operating member A2 in a condition that the first operating lever 28 is located in the neutral position and simultaneously the operating member A4 is being operated. Alternatively, one of the functions of the automatic control may be configured to be performed by operating the operating member B2 in a condition that the second operating lever 29 is located in the neutral position and simultaneously the operating member B4 is being operated.

Alternatively, a predetermined function (first function) of the automatic control may be configured to be performed by operating the operating member A2 in a condition that the first operating lever 28 is located in the neutral position and simultaneously the operating member A4 is not being operated. Moreover, a predetermined function (third function) of the automatic control, which is different from the first function, may be configured to be performed by operating the operating member A2 in a condition that the second operating lever 29 is located in the neutral position and simultaneously the operating member A4 is being operated.

For example, the first function may be a function of changing the position of the aforementioned designed surface 41 upward or downward. The third function may be a function of selecting the designed surface 41 from the plural designed surfaces 41. Alternatively, the third function may be a function of changing the display scaling in the guidance screen 61. The first and third functions may be respectively different from those described above.

Conditions included in the aforementioned performance condition may be changed. Alternatively, conditions different from those described above may be added to the conditions included in the performance condition. The performance condition is not limited to that the operating levers are located in their neutral positions, and may include another condition indicating that the operating levers are not being operated by the operator.

According to the present invention, it is possible to easily operate a function of an automatic control, prevent occurrence of an unintentional motion of a work implement attributed to an erroneous operation, and perform a construction work with good quality by the automatic control.

The invention claimed is:

1. A control system for a work vehicle including a work implement, the control system comprising:

a first operating lever for the work implement;

a first operating member provided on the first operating lever; and a controller configured to perform an automatic control of the work implement, the automatic control being based on a designed terrain indicating a target shape of a work object, the controller being configured to perform a function of the automatic control in response to operating the first operating member when a performance condition is satisfied, the function being allocated to the first operating member, the performance condition including that the first operating lever is located in a neutral position thereof.

2. The control system for a work vehicle according to claim 1, wherein the controller is configured to change a position of the designed terrain in response to operating the first operating member when the performance condition is satisfied.

3. The control system for a work vehicle according to claim 1, wherein the first operating member causes a first function of the automatic control to be performed, and the control system further comprises a second operating member for causing a second function of the automatic control to be performed, the second function being different from the first function.

4. The control system for a work vehicle according to claim 3, wherein the controller is configured to enable or disable the automatic control in response to operating the second operating member when the performance condition is satisfied.

5. The control system for a work vehicle according to claim 3, wherein the first operating member and the second operating member are provided on the first operating lever, and the controller is configured to perform the first function in response to operating the first operating member when the performance condition is satisfied, the controller being configured to perform the second function in response to operating the second operating member when the performance condition is satisfied.

6. The control system for a work vehicle according to claim 3, further comprising a second operating lever on which the second operating member is provided.

7. The control system for a work vehicle according to claim 6, wherein the controller is configured to perform the first function in response to operating the first operating member when a first performance condition is satisfied, the controller being configured to perform the second function in response to operating the second operating member when a second performance condition is satisfied, the first performance condition including that the first operating lever is located in the neutral position thereof, the second performance condition including that the second operating lever is located in a neutral position thereof.

8. The control system for a work vehicle according to claim 6, wherein the performance condition includes that the first operating lever is located in the neutral position thereof and that the second operating lever is located in a neutral position thereof, and the controller is configured to perform the first function in response to operating the first operating member when the performance condition is satisfied, the controller being configured to perform the second function in response to operating the second operating member when the performance condition is satisfied.

9. The control system for a work vehicle according to claim 1, further comprising a third operating member provided on the first operating lever, the performance condition including that the third operating member is being operated.

10. The control system for a work vehicle according to claim 9, wherein the controller is configured to perform a first function of the automatic control in response to operating the first operating member when a first performance condition is satisfied, the controller being configured to perform a third function of the automatic control in response to operating the first operating member when a third performance condition is satisfied, the third function being different from the first function, the first performance condition including that the first operating lever is located in the neutral position thereof and that the third operating member is not being operated, the third performance condition including that the first operating lever is located in the neutral position thereof and that the third operating member is being operated.

11. A method of controlling a work vehicle including a work implement, the method comprising the steps of:

receiving a positional signal indicating a position of a first operating lever for the work implement;

receiving an operating signal indicating operation of a first operating member provided on the first operating lever;

determining whether or not a performance condition is satisfied, the performance condition including that the first operating lever is located in a neutral position thereof;

performing an automatic control of the work implement, the automatic control being based on a designed terrain indicating a target shape of a work object and performing a function of the automatic control of the work implement in response to operating the first operating member when the performance condition is satisfied, the function being allocated to the first operating member.

12. A work vehicle, comprising:

a work implement;

a first operating lever for the work implement;

a first operating member provided on the first operating lever; and a controller configured to perform an automatic control of the work implement, the automatic control being based on a designed terrain indicating a target shape of a work object, the controller being configured to perform a function of the automatic control in response to operating the first operating member when a performance condition is satisfied, the function being allocated to the first operating member, the performance condition including that the first operating lever is located in a neutral position thereof.

* * * * *